US011852365B1

(12) United States Patent
Bergmann

(10) Patent No.: US 11,852,365 B1
(45) Date of Patent: Dec. 26, 2023

(54) FIELD NORMALIZATION OF AIR CONDITIONING FOR CAPACITY AND EFFICIENCY DETERMINATION COMPARED TO AHRI DESIGN CONDITIONS

(71) Applicant: Manifold Cloud Services, LLC, Mogadore, OH (US)

(72) Inventor: James LaMont Bergmann, Akron, OH (US)

( * ) Notice: Subject to any disclaimer, the term of this patent is extended or adjusted under 35 U.S.C. 154(b) by 220 days.

(21) Appl. No.: 17/110,264

(22) Filed: Dec. 2, 2020

Related U.S. Application Data

(60) Provisional application No. 62/942,605, filed on Dec. 2, 2019.

(51) Int. Cl.
*F24F 11/46* (2018.01)
*F24F 11/52* (2018.01)
*F24F 140/60* (2018.01)

(52) U.S. Cl.
CPC ..... *F24F 11/46* (2018.01); *F24F 11/52* (2018.01); *F24F 2140/60* (2018.01)

(58) Field of Classification Search
CPC ..... F24F 11/46; F24F 11/52; F24F 2140/60
See application file for complete search history.

(56) References Cited

U.S. PATENT DOCUMENTS 8,949,091 B2 * 2/2015 Bhagwat ..... H05K 7/20836 703/13
2008/0183424 A1 * 7/2008 Seem ..... G05B 23/0216 702/181
2015/0330650 A1 * 11/2015 Abiprojo ..... F24F 11/39 700/276
2017/0074534 A1 * 3/2017 Turner ..... F24F 11/30

OTHER PUBLICATIONS

AHRI Standard, 10 pages (Year: 2023).*

* cited by examiner

*Primary Examiner* — Tung S Lau
(74) *Attorney, Agent, or Firm* — Calfee, Halter & Griswold LLP

(57) ABSTRACT

Described herein are technologies pertaining to a computer-implemented system that is configured to present information to a technician who is servicing an air conditioning unit. The technologies described herein facilitate computation of a value that is indicative of operating efficiency of an air conditioning unit in its current environment and with current operating conditions.

20 Claims, 7 Drawing Sheets

EXTENDED REFRIGERANT LINE CORRECTION FACTORS

Varying Line Length in Feet ( m ) vs. Total Capacity Multiplier

| 25 ( 8 ) | 50 ( 15 ) | 75 ( 23 ) | 100 (30 ) | 125 (38 ) | 150 (46 ) |
|---|---|---|---|---|---|
| 1.00 | .99 | .98 | .96 | .94 | .92 |

REFRIGERANT CHARGE DATA

All models are factory charged with R-22 for outdoor unit. 25' ( 8m ) of refrigerant line and matching indoor section. Refrigerant charge correction per foot ( 305mm) of line: 1/4" O.D. = .25 oz.; 5/16" O.D. = .45 oz.; 3/8" O.D. = .60 oz.; 1/2" O.D. = 1.2 oz.

VOLTAGE CORRECTION FACTORS

| Volts | Capacity | Watts |
|---|---|---|
| 208 | .98 | .99 |

INDOOR AIRFLOW CORRECTION TABLE

| % Rated Air | 90 | 95 | 100 | 105 | 110 |
|---|---|---|---|---|---|
| Total Cap. Mult. | .98 | .99 | 1.00 | 1.01 | 1.03 |
| Sens Cap. Mult. | .93 | .98 | 1.00 | 1.03 | 1.05 |

INDOOR TEMPERATURE CORRECTION TABLE (Based on 95°F Ambient)

| Indoor D.B. °F (°C). | Correction Factor | Entering Indoor Wet Bulb °F (°C). | | | | | | |
|---|---|---|---|---|---|---|---|---|
| | | 59 (15) | 61 (16) | 63 (17) | 65 (18) | 67 (19) | 69 (20) | 71 (21) |
| 70 (21 ) | Total Cap. Mult. | **.90** | .93 | .96 | .99 | 1.02 | - | - |
| | Sens Cap. Mult. | **.86** | .85 | .82 | .77 | .70 | - | - |
| 75 (24) | Total Cap. Mult. | .89 | .92 | **.95** | .98 | 1.01 | 1.04 | - |
| | Sens Cap. Mult. | 1.04 | 1.03 | **1.00** | .95 | .88 | .78 | - |
| 80 (26) | Total Cap. Mult. | .88 | .91 | .94 | .97 | **1.00** | 1.03 | 1.06 |
| | Sens Cap. Mult. | 1.18 | 1.17 | 1.14 | 1.08 | **1.00** | .89 | .73 |
| 85 (29) | Total Cap. Mult. | - | .90 | .93 | .96 | .99 | 1.02 | **1.05** |
| | Sens Cap. Mult. | - | 1.29 | 1.26 | 1.20 | 1.11 | .98 | **.81** |

Bold Type = approximately 50% Relative Humidity

300

FIG. 3

RATING CONDITIONS
20 °F Superheat
15 °F Subcooling
95 °F Ambient Air Over

60 Hz Operation

AIR CONDITIONING

400

Evaporating Temperature °F (Sat Dew Pt Pressure, psig)

| Condensing Temperature °F (Sat Dew Pt Pressure, psig) | | -10(16) | 0(24) | 10(33) | 20(43) | 30(55) | 40(66) | 45(76) | 50(84) | 55(93) |
|---|---|---|---|---|---|---|---|---|---|---|
| 150 (381) | C | | | | | 16000 | 21200 | 24200 | 27500 | 31100 |
| | P | | | | | 2570 | 2890 | 3040 | 3180 | 3320 |
| | A | | | | | 12.2 | 13.5 | 14.2 | 14.8 | 15.4 |
| | M | | | | | 266 | 348 | 394 | 443 | 497 |
| | E | | | | | 6.2 | 7.4 | 8 | 8.8 | 9.4 |
| | % | | | | | 61.7 | 63.8 | 64.6 | 65.3 | 65.8 |
| 140 (337) | C | | | | 13200 | 18000 | 23800 | 27000 | 30600 | 34500 |
| | P | | | | 2180 | 2490 | 2770 | 2900 | 3020 | 3140 |
| | A | | | | 10.6 | 11.9 | 13 | 13.6 | 14.1 | 14.6 |
| | M | | | | 211 | 284 | 369 | 416 | 468 | 525 |
| | E | | | | 6 | 7.2 | 8.6 | 9.3 | 10.1 | 11 |
| | % | | | | 59.8 | 62.8 | 64.9 | 65.6 | 66.1 | 66.4 |
| 130 (297) | C | | | 10400 | 15000 | 20200 | 26500 | 30000 | 33900 | 38100 |
| | P | | | 1840 | 2150 | 2420 | 2650 | 2750 | 2850 | 2940 |
| | A | | | 9.2 | 10.4 | 11.5 | 12.6 | 12.9 | 13.4 | 13.8 |
| | M | | | 161 | 227 | 303 | 390 | 439 | 493 | 550 |
| | E | | | 5.7 | 7 | 8.4 | 10 | 10.9 | 11.9 | 13 |
| | % | | | 56.5 | 60.8 | 63.6 | 65.4 | 66 | 66.4 | 66.5 |
| 120 (260) | C | | | 12000 | 16900 | 22500 | 29200 | 33000 | 37200 | 41700 |
| | P | | | 1840 | 2100 | 2330 | 2510 | 2590 | 2670 | 2730 |
| | A | | | 9.2 | 10.2 | 11.1 | 11.9 | 12.3 | 12.6 | 12.8 |
| | M | | | 177 | 244 | 322 | 412 | 462 | 515 | 575 |
| | E | | | 6.5 | 8 | 9.7 | 11.6 | 12.7 | 14 | 15.3 |
| | % | | | 57.6 | 61.4 | 63.9 | 65.4 | 65.8 | 66 | 65.8 |
| 110 (226) | C | | 9170 | 13700 | 18900 | 24900 | 32000 | 36100 | 40500 | 45400 |
| | P | | 1550 | 1620 | 2040 | 2220 | 2360 | 2420 | 2460 | 2500 |
| | A | | 8.1 | 9.1 | 10 | 10.7 | 11.3 | 11.5 | 11.7 | 11.9 |
| | M | | 131 | 193 | 261 | 340 | 432 | 484 | 540 | 600 |
| | E | | 5.9 | 7.5 | 9.2 | 11.2 | 13.6 | 14.9 | 16.5 | 18.2 |
| | % | | 52.6 | 58.2 | 61.6 | 63.7 | 64.8 | 65 | 64.8 | 64.2 |
| 100 (196) | C | | 10700 | 15400 | 20900 | 27300 | 34900 | 39200 | 43900 | 49000 |
| | P | | 1560 | 1780 | 1960 | 2100 | 2190 | 2210 | 2230 | 2240 |
| | A | | 8.1 | 9 | 9.7 | 10.2 | 10.6 | 10.7 | 10.8 | 10.8 |
| | M | | 146 | 208 | 278 | 358 | 452 | 505 | 560 | 625 |
| | E | | 6.9 | 8.7 | 10.6 | 13 | 16 | 17.7 | 19.6 | 21.8 |
| | % | | 53.8 | 58.4 | 61.3 | 62.9 | 63.5 | 63.3 | 62.7 | 61.5 |
| 90 (168) | C | 7830 | 12200 | 17200 | 22900 | 29600 | 37600 | 42200 | 47100 | 52500 |
| | P | 1300 | 1540 | 1720 | 1860 | 1940 | 1980 | 1980 | 1980 | 1960 |
| | A | 7.2 | 8.1 | 8.7 | 9.2 | 9.6 | 9.7 | 9.8 | 9.7 | 9.7 |
| | M | 104 | 160 | 222 | 293 | 374 | 469 | 525 | 580 | 645 |
| | E | 6 | 7.9 | 10 | 12.3 | 15.2 | 19 | 21.2 | 23.8 | 26.8 |
| | % | 47.7 | 54.4 | 58.2 | 60.4 | 61.5 | 61.4 | 60.7 | 59.4 | 57.4 |
| 80 (144) | C | 9230 | 13700 | 18800 | 24800 | 31900 | 40300 | 45000 | 50000 | 56000 |
| | P | 1300 | 1490 | 1630 | 1720 | 1760 | 1750 | 1720 | 1680 | 1640 |
| | A | 7.2 | 7.9 | 8.4 | 8.7 | 8.9 | 8.8 | 8.7 | 8.6 | 8.4 |
| | M | 118 | 174 | 236 | 306 | 388 | 485 | 540 | 600 | 660 |
| | E | 7.1 | 9.2 | 11.5 | 14.4 | 18.1 | 23.1 | 26.2 | 29.8 | 34.2 |
| | % | 49.3 | 54.5 | 57.5 | 59.1 | 59.5 | 58.3 | 56.8 | 54.3 | 50.9 |

*Nominal Performance Values (±5%) based on 72 hours run-in. Subject to change without notice. Current @ 230 V*

C:Capacity(Btu/hr), P:Power(Watts), A:Current(Amps), M:Mass Flow(lbs/hr), E:EER(Btu/Watt-hr), %:Isentropic Efficiency(%)

FIG. 4

FIELD NORMALIZATION OF AIR CONDITIONING FOR CAPACITY AND EFFICIENCY DETERMINATION COMPARED TO AHRI DESIGN CONDITIONS

RELATED APPLICATION

This application claims priority to U.S. Provisional Patent Application No. 62/942,605, filed on Dec. 2, 2019, and entitled "FIELD NORMALIZATION OF AIR CONDITIONING FOR CAPACITY AND EFFICIENCY DETERMINATION COMPARED TO AHRI DESIGN CONDITIONS". The entirety of this application is incorporated herein by reference.

BACKGROUND

Air conditioning units in the heating, ventilating, and air conditioning (HVAC) industry are factory or lab tested and rated and specified at Air Conditioning, Heating, and Refrigeration Institute (AHRI) conditions (typically 80 degrees indoors, 50% Relative humidity indoors, and 95 degrees outdoors) for efficiency and capacity. Extended performance tables and derating tables are used by designers and field technicians to determine the efficiency outside of AHRI conditions. These tables have wide ranges and often must be interpreted for the actual conditions encountered that can be measured at a much more granular level. These tables are used outside of AHRI conditions to estimate the normalized output of an air conditioning unit under conditions outside of AHRI design.

By design, air conditioning units have two primary processes: 1) Sensible Cooling, which relates to removal of heat that can be measured with a thermometer; and 2) Latent Cooling, which refers to removal of "hidden heat" by the condensing of water vapor (humidity).

In an air conditioning unit, a portion of cooling capacity is dedicated to Sensible Cooling and a portion is dedicated to Latent Cooling (Sensible/Latent split or S/L split). The split is calculated as a fraction of the total cooling capacity of the air conditioning unit. A typical S/L split would be 0.75, meaning 75% of the cooling is dedicated to Sensible Cooling and 25% to Latent Cooling at the design conditions (e.g., the AHRI conditions). Typically, S/L split is adjusted by increasing or decreasing the system airflow across an evaporator coil of the air conditioning unit. If the temperature of the coil falls below the dewpoint temperature (the temperature at which water will condense on a surface), condensing of water vapor will occur and latent cooling will commence. The air conditioning unit will continue with Latent Cooling until the latent load is removed.

If the latent load is excessive, the Sensible Cooling capacity of the air conditioning unit will be reduced. Once the evaporator coil drops below the return air dewpoint temperature, the condensing process starts and cannot be stopped until the latent load is removed or controlled. If there is no latent load, the capacity of the air conditioning unit dedicated to Latent Cooling will be unused. In arid climates, because there is little to no latent load, the air volume across the coil is increased to convert some of the dedicated Latent Cooling capacity to Sensible Cooling capacity, as the Latent Cooling capacity would otherwise be unused. Combined, the Sensible and Latent Cooling capacity determines the Total Capacity of the air conditioning unit (e.g., the work that the air conditioning unit can perform).

For an air conditioning unit to operate at full capacity, there has to be enough Sensible heat and Latent heat (total load) available to be cooled.

As noted above, the Sensible Capacity of the air conditioning unit is what creates an air temperature drop across the evaporator coil and the resulting decrease in space temperature of an indoor region (e.g., in a home), which will eventually (if adequately sized) result in a thermostat shutting off the air conditioning unit.

The thermostat is a switch that is actuated by a change in sensible temperature. The primary control, therefore, is of sensible temperature only, and the Latent Cooling is a byproduct of the sensible cooling process. If the evaporator coil falls below the dewpoint temperature, Latent Cooling will occur. If the coil is above the dewpoint only Sensible Cooling occurs. The system cannot operate at its full Sensible Cooling capacity until the latent capacity is at or below the designed S/L split. Put differently, until the space is dehumidified, the Sensible Cooling that satisfies the space temperature will be limited.

In the HVAC industry, Energy Efficiency Ratio (EER) is commonly expressed as the Total Cooling British Thermal Units per Hour (BTUH) output/watts or power consumed. EER for an HVAC system, including an air conditioning unit, is stated at AHRI conditions. The rated EER is expressed as a function of the Total Capacity.

The operation, efficiency, and capacity of an air conditioning unit is a function of the design, the mechanical installation, the refrigerant charge, and the current load conditions. It should also be noted that unlike a lab that can be held at constant conditions, in practice, air conditioning is a dynamic process, and the load is continually changing from the second the air conditioning unit is started. The efficiency and capacity changes as a function of the load, and the load is continually changing making it impossible for a field technician to determine if the air conditioning unit is operating optimally for both cooling capacity and output as well as electrical consumption during field testing. In short, the HVAC industry is selling capacity and efficiency but has no process of normalizing capacity and efficiency for operating conditions in the field (and thus there is no process for comparing actual performance of an air conditioning unit to rated performance of the air conditioning unit).

BRIEF DESCRIPTION OF THE DRAWINGS

FIG. 3 depicts exemplary performance tables.

FIG. 4 depicts an exemplary compressor map.

DETAILED DESCRIPTION

Figure 1:
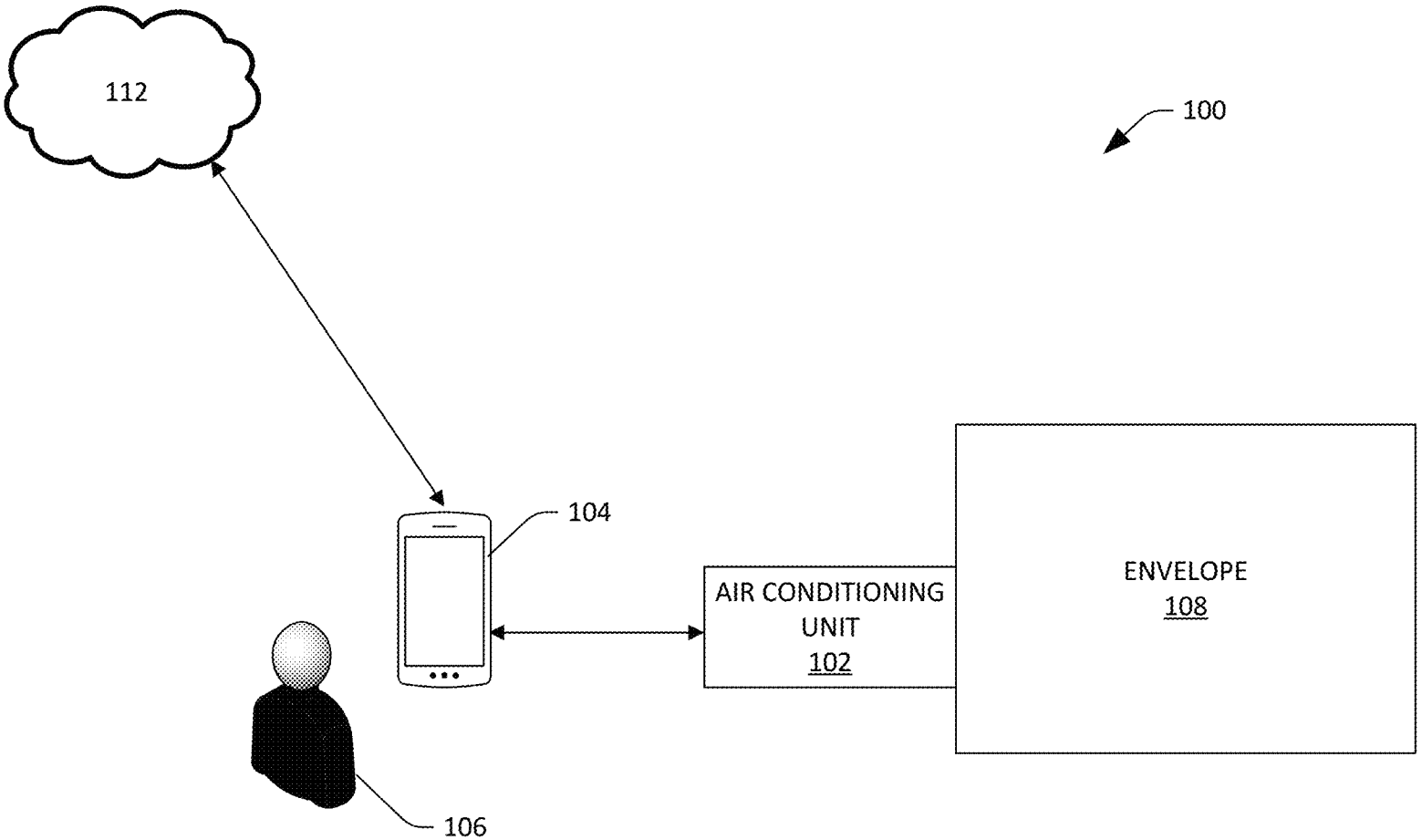
FIG. 1 is a functional block diagram of an exemplary system for measuring performance of an air conditioner unit.

Various technologies pertaining to normalization of air conditioning performance for as-installed sensible capacity and efficiency with respect to AHRI design conditions are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Further, as used herein, the terms "component" and "system" are intended to encompass computer-readable data storage that is configured with computer-executable instructions that cause certain functionality to be performed when executed by a processor. The computer-executable instructions may include a routine, a function, or the like. It is also to be understood that a component or system may be localized on a single device or distributed across several devices. Further, as used herein, the term "exemplary" is intended to mean serving as an illustration or example of something and is not intended to indicate a preference.

For measuring performance of an air conditioning unit, total capacity is a function of the latent and sensible load, and the latent load may or may not exist. In short, if the Sensible Cooling capacity is increased, the cooling process will be brought to an end more quickly (e.g., the temperature will drop more quickly, and the thermostat will shut down the air conditioning unit). If cooling (reducing the temperature) is the primary process of the air conditioning unit, then optimizing the air conditioning unit for Sensible Cooling while allocating just enough System Capacity of the air conditioning unit to Latent Cooling to satisfy a latent load should be the goal of the service technician. A value that is indicative of sensible capacity can be constantly derived and is a better metric for overall system performance compared to conventional metrics. If the sensible capacity is divided by the power consumed, the Sensible Energy Efficiency Ratio (EER) is obtained. Sensible EER=(Sensible Capacity in BTUh/Watts).

Turning now to FIG. 1, illustrated is a system 100 configured to normalize performance metrics of an installed and operating air conditioning unit, wherein the performance metrics are normalized with respect to performance metrics for the air conditioner at ATARI design conditions. More specifically, the system 100 may be configured to dynamically and continuously calculate a Sensible Energy Efficiency Ratio (EER), wherein such Sensible EER can be compared by a technician to a rated Sensible EER to determine overall efficiency of an air conditioning unit. The system 100 comprises an air conditioning unit 102, wherein values indicative of performance of the air conditioning unit are being computed and displayed at a mobile computing device 104 that is operated by a user 106 (e.g., a field technician). The air conditioning unit 102 is configured to alter a temperature of an envelope 108 (e.g., a building, a room, etc.). In the illustrated embodiment, the air conditioning unit 102 is outside the envelope 108; however, the air conditioning unit 102 may be placed at any suitable location relative to the envelope 108. The mobile computing device 104 may include any suitable type of mobile computing device, including a laptop computing device, a mobile telephone, a tablet computing device, a wearable computing device, and/or the like.

Figure 2:
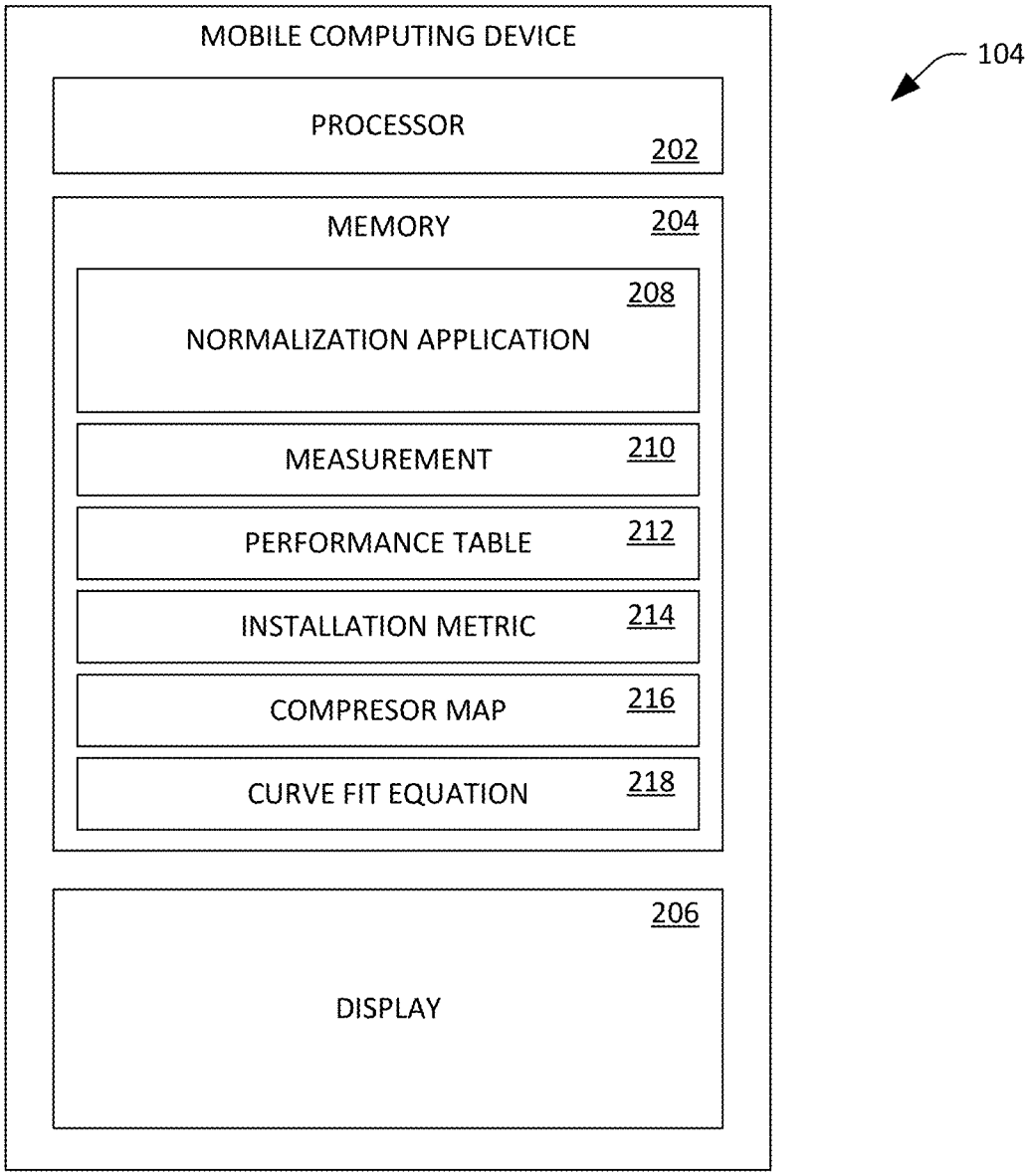
FIG. 2 is a functional block diagram of an exemplary mobile computing device.

Referring briefly to FIG. 2, a functional block diagram of the mobile computing device 104 is depicted. The mobile computing device 104 comprises a processor 202 and memory 204, wherein the memory 204 includes instructions that are executed by the processor 202. In addition, the mobile computing device 104 comprises a display 206 that is operably coupled to the processor 202, wherein graphics can be presented on the display 206 to the user 106.

The memory 204 comprises a normalization application 208 that is executed by the processor 202, wherein the normalization application 208 is configured to receive a measurement 210 that is indicative of an operating condition of the air conditioning unit 102 as the air conditioning unit 102 is cooling the envelope. The measurement 210 may be manually entered by the user 106 into the mobile computing device 104 by way of an interface, such as a keypad, a touch-sensitive display, a microphone, etc. In another example, the measurement may be received from a tool that is coupled to the air conditioning unit 102 and is in communication with the mobile computing device 104 by way of a suitable communications medium. For example, the tool (not shown) can be configured to generate the measurement 210 that is indicative of the operating condition of the air conditioning unit 102, and can be further configured to wirelessly transmit the measurement 210 to the mobile computing device 104.

The normalization application 110 may be configured to calculate a Normalized Sensible EER based upon the measurement 210, and can further be configured to output data that is indicative of a comparison of the Normalized Sensible EER to an expected (rated) Sensible EER of the air conditioning unit 102. Further, the normalization application 208 can update the Normalized Sensible EER each time a new measurement is received, and thus can compute the Normalized Sensible EER in real-time. For instance, the measurement 210 can be indicative of Sensible BTUH output/watts and/or power being consumed by the air conditioning unit 102. The normalization application 208 computes the Normalized Sensible EER based upon one or more of an extended performance table 212, an installation metric 214, a compressor map 216, and/or a curve fit equation(s) for the extended performance table 212.

The normalization application 208 may be further configured to use derating and/or rerating tables of the air conditioning unit 102, modeling the data, and/or curve fitting equations to extrapolate operation data by continuously derating and/or rerating the air conditioning unit 102 to compare a derated and/or rerated sensible capacity of the air conditioning unit 102 to an actual measured sensible capacity of the air conditioning unit 102. The actual measured sensible capacity may take into account field installation parameters and/or current load conditions on the air conditioning unit 102.

In order to determine the Normalized Sensible EER, the normalization application 208 can extrapolate certain information from the performance table 212 to determine a normalized capacity and efficiency for the air conditioning unit 102. This information can include "correction factors" that are used when calculating the Sensible EER, as will be discussed in detail below. The correction factors may be based on the measurement 210 provided to the normalization application 208. The normalization application 208 can be configured to default to a correction factor of 1.00 where the measurement 210 has not been received at the mobile computing device 104, and thus a correction factor is unable to be determined from the performance table 212. The aforementioned information can include rated capacity of the air conditioning unit 102 at AHRI conditions (conventionally this comprises: 80 degrees in the envelope 108, 50% relative humidity in the envelope 108, and 95 degrees outside the envelope 108), rated airflow of the air conditioning unit 102 at AHRI conditions, rated sensible latent split (SL split) of the air conditioning unit 102 at AHRI conditions, rated EER and Sensible EER of the air conditioning unit 102 at AHRI conditions, rated voltage of the air conditioning unit 102 at AHRI conditions, rated electrical frequency of the air conditioning unit at AHRI conditions, rated line set length of the air conditioning unit 102 (factory charged for 15 feet for example) at AHRI conditions, rated superheat of the air conditioning unit 102, rated subcooling of the air conditioning unit 102, and/or rated performance of the air conditioning unit 102 outside of AHRI conditions as provided by the extended performance table 212. The normalization application 208 can compute the Normalized Sensible EER based upon the measurement 210, where the measurement 210 can be indicative of one or more of actual airflow, actual SL split, actual inside the envelope 108 temperature and humidity (or wet bulb or dewpoint), actual outside the envelope 108 air temperature, actual applied voltage, actual frequency, actual line set length, actual superheat, and/or actual subcooling.

Data from the performance table 212 and/or the compressor map 216 may be curve fitted to determine a mathematical representation (e.g., a curve fit equation) of an expected cooling performance of the air conditioning unit 102. The data may be curve fitted via any suitable means. For example, the data may be entered into a spreadsheet and curve fitted therefrom.

The normalization application 208 can use the resulting mathematical representation(s) to determine expected sensible, latent or total cooling as well as electrical consumption so an expected Total or Sensible EER can be derived. The normalization can use the mathematical representation(s) to dynamically calculate an expected capacity and/or efficiency based upon the measurement 212 received from the tool that is in communication with the mobile computing device 104.

The normalization application 208 can further perform a comparison of expected Sensible EER to the Normalized Sensible EER to compute a percentage of the expected capacity or EER. In the preceding embodiments, the calculation(s) and comparison are performed by the normalization application 110. However, it is contemplated that a cloud-based system 112 (FIG. 1) may perform one or more of the calculations and/or comparisons. For example, the mobile computing device 104 may be in communication with the cloud-based system 112 via the Internet and/or intranet and may transmit data to and/or receive data from the cloud-based system 112 via this communication.

A goal for the service technician 106 is to get the equipment to operate as close to 100% of the sensible capacity at 100% of the Sensible EER as possible. The service technician may achieve these capacity and efficiency goals by optimizing the equipment selection, equipment installation, refrigerant charge and evaporator airflow to achieve the sensible cooling requirements. In an example, the normalization application 208 can output recommendations as to equipment, installation steps, refrigerant charge, evaporator airflow, etc. to the service technician 106 by way of the display 206.

Exemplary calculations performed by the normalization application 208 will now be discussed with reference to manufacturer derating tables 300 illustrated in FIG. 3

Example 1: Calculating an Airside Sensible EER for a 2-ton air conditioning unit. In the following example, at AHRI conditions, the air conditioning unit 102 is rated 24,000 BTUH and has a design sensible latent split of 0.75. The air conditioning unit 102 further has a line set length of 25', a voltage of 230V, an indoor airflow of 400 CFM/ton, an indoor dry bulb temperature of 80° F. and a wet bulb temperature of 67° F., and an outdoor air temperature of 95° F. The normalization application 208 can compute a correction factor may be determined for each of the above described measurements based upon information in the derating tables depicted in FIG. 3. For instance, a line set length of 25' has a correction factor of 1.00, an indoor dry bulb temperature of 80° F. with a wet bulb temperature of 67° F. has a correction factor of 1.00, and so on. For convenience, standard air equations are employed. More complex equations may be used that consider air density, moist air such as those described by Hyland and Wexler used in the ASHREA Handbook.

The normalization application 208 can multiple the AHRI BTUH Rating of the air conditioning unit 102 by each of these correction factors. In this example, the resulting "corrected" BTUH would be 24,000 BTUH because the equation would be 24,000 BTUH*1*1*1*1*1=24,000 BTUH. As noted above, EER is BTUH output/watts of input. In order to determine total expected EER of the air conditioning unit 102, the normalization application 208 can divide the corrected BTUH by the measured power used by the air conditioning unit 102.

$$\text{Total or System EER} = \text{Total Capacity/Watts of Input} \quad (1)$$

In this example, the measurement 210 indicates that the measured power is 2.4 kW, resulting in 10 EER.

In order to determine sensible capacity, the normalization application 208 can multiple the total BTUH by the sensible latent split. In this example, sensible capacity=24,000 BTUH*0.75=18,000 BTUH. The normalization application 208 can compute how much the air temperature should change going across evaporator coils in the air conditioning unit 102 based upon the sensible capacity. The normalization application 208 can compute the air temperature change through use of the following equation:

$$\Delta t = \text{Sensible Capacity}/(1.08*400\ \text{CFM/ton}*2\ \text{ton}) \quad (2)$$

Accordingly, in this example, the normalization application 208 can compute the desired air temperature change Δt to be 20.8° F.

Using the same equation for a measured Δt over the evaporator, the normalization application 208 can compute an actual sensible capacity:

$$\text{Sensible Capacity}=\Delta t*1.08*400\text{CFM/ton}*2\text{ ton} \quad (3)$$

If the measured Δt is 20.8° F., the normalization application 208 can compute the actual sensible capacity to be 18,000.

The normalization application 208 can compute the Sensible EER through use of the following equation:

$$\text{Sensible EER}=\text{Sensible Capacity/Watts of Input} \quad (4)$$

Thus, pursuant to this example, the target Sensible EER is 18,000 BTUH/2400 W resulting in 7.5. The actual Sensible EER is 18,000 BTUH/2400 W resulting in 7.5. Because the target Sensible EER and the actual Sensible EER are the same, the normalization application 208 may display an indication on the display 206 that the air conditioning unit 102 is operating at 100% efficiency.

The normalization application 208 can additionally calculate a compressor EER for comparison to the normalized sensible EER. This calculation may be used to determine whether the sensible EER was calculated correctly. The normalization application 208 can compute the compressor EER by using a compressor map 400, illustrated in FIG. 4. As depicted in the exemplary compressor map 400 a compressor capacity for a condensing temperature of 120° F. and an evaporating temperature of 45° F. would be 26,600 BTUH for an exemplary air conditioning unit. Accordingly, the Compressor EER is 26,600 BTUH/2400 W equaling 11.08. By comparison, the System EER is 10. The closeness of the Compressor EER and the System EER can act as indication the System EER was calculated correctly.

Figure 5:
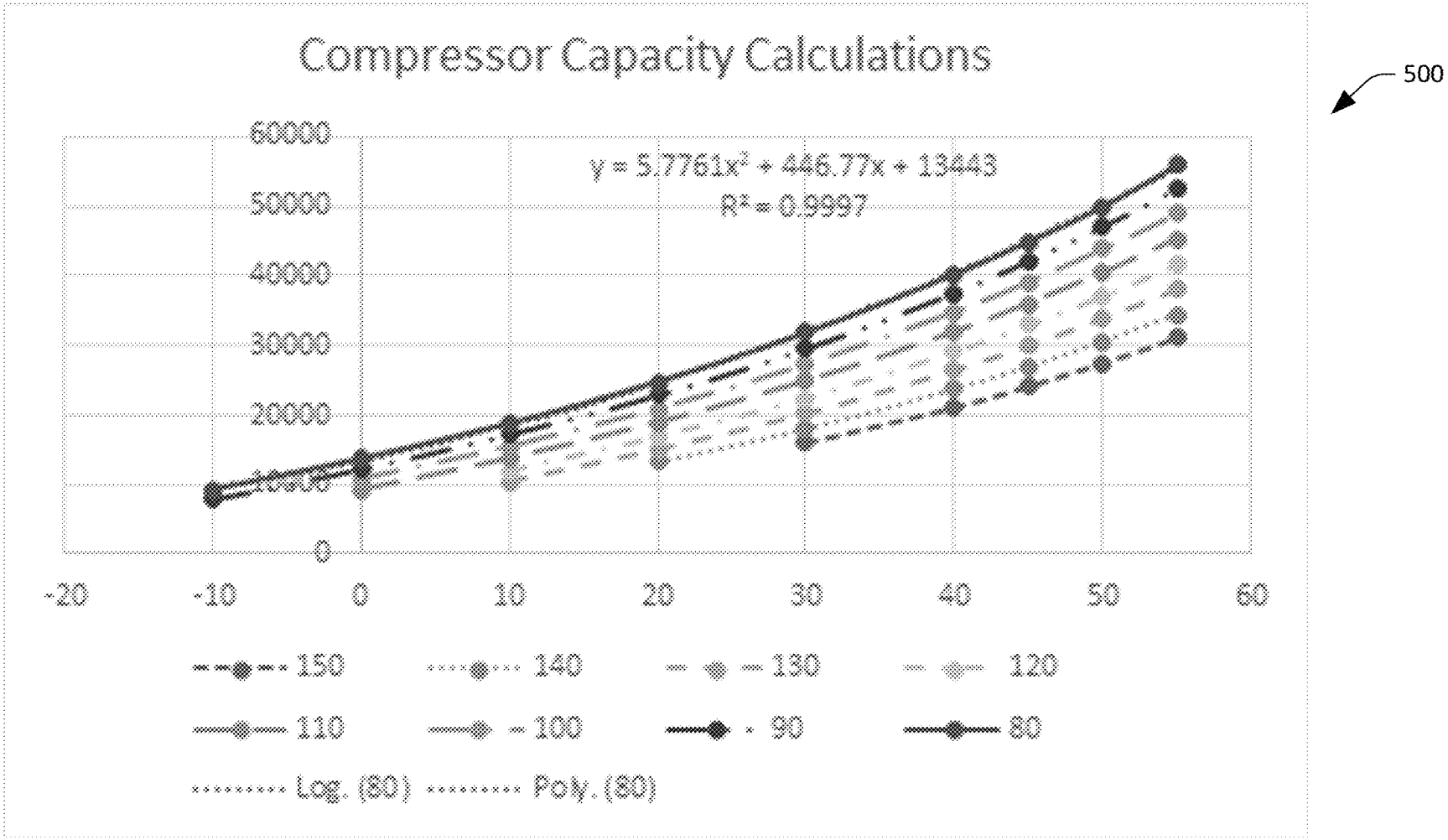
FIG. 5 depicts an exemplary curve fitting of a compressor map.

Similar to the graph described above, the compressor map 400 depicted in FIG. 4 can be curve-fitted to determine a mathematical representation (e.g., a curve fit equation) of an expected capacity of the compressor corresponding to such compressor map 400. FIG. 5 depicts an exemplary curve fit 500 for compressor map 400.

Figure 6:
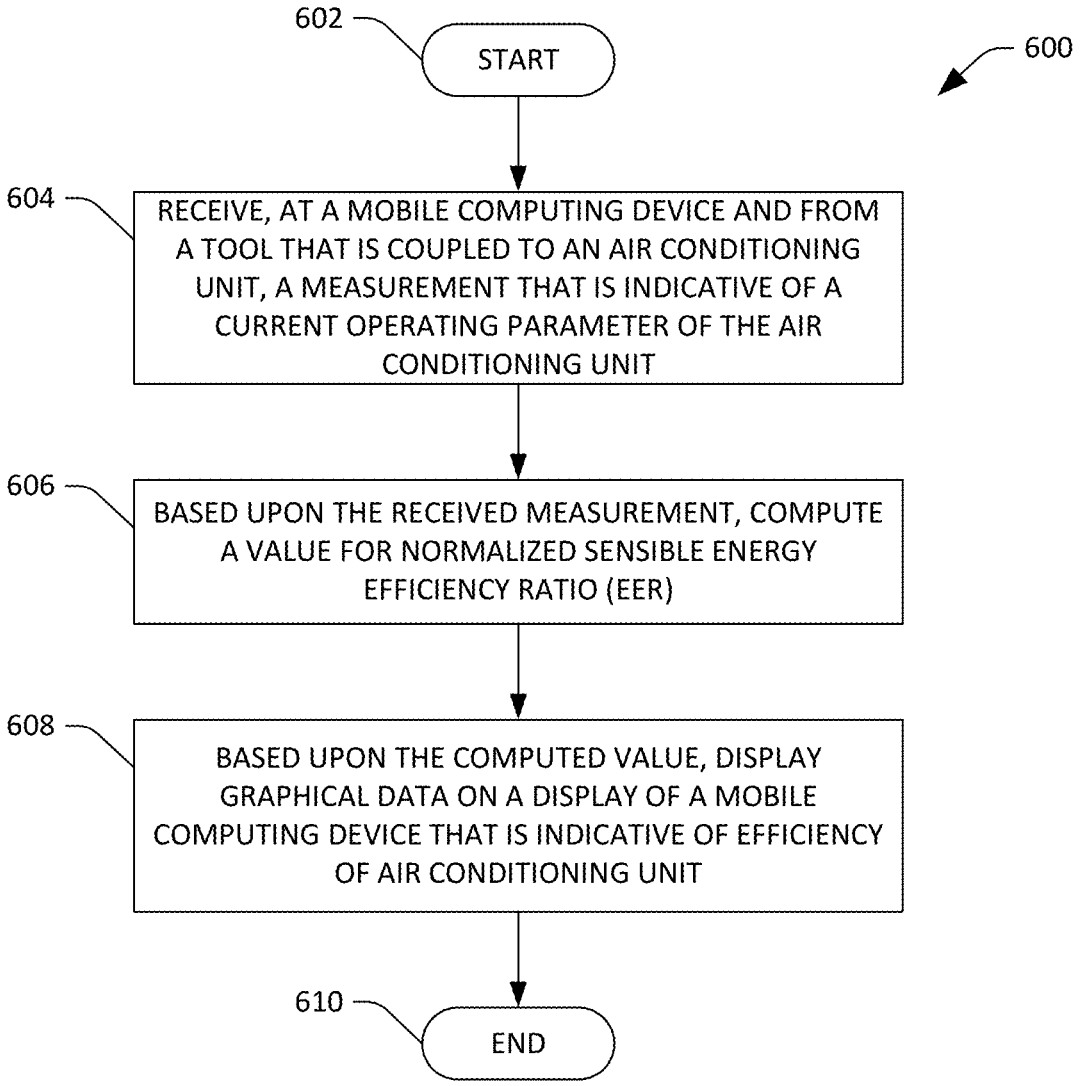
FIG. 6 is a flow diagram illustrating an exemplary methodology for computing a value that is indicative of performance of an air conditioning unit.

FIG. 6 illustrates an exemplary methodology 600 relating to evaluating performance of an air conditioning unit. While the methodology is shown and described as being a series of acts that are performed in a sequence, it is to be understood and appreciated that the methodology is not limited by the order of the sequence. For example, some acts can occur in a different order than what is described herein. In addition, an act can occur concurrently with another act. Further, in some instances, not all acts may be required to implement a methodology described herein.

Moreover, the acts described herein may be computer-executable instructions that can be implemented by one or more processors and/or stored on a computer-readable medium or media. The computer-executable instructions can include a routine, a sub-routine, programs, a thread of execution, and/or the like. Still further, results of acts of the methodologies can be stored in a computer-readable medium, displayed on a display device, and/or the like.

The methodology 600 is performed by a mobile computing device, such as a mobile telephone. The methodology 600 starts at 602, and at 604 a measurement that is indicative of a current operating parameter of an air conditioning unit is received, wherein the measurement is received from a tool in communication with the mobile computing device, and further wherein the tool is coupled to the air conditioning unit. In an example, the tool can output several measurements that are indicative of different operating parameters of the air conditioning unit, wherein exemplary measurements have been set forth above. Further, and optionally, measurements can be manually input by a service technician who is servicing the air conditioning unit.

At 606, based upon the received measurement, a value for normalized sensible EER is computed by the mobile computing device. For instance, the value for normalized sensible EER can be computed based upon a performance table for the air conditioning unit, based upon a curve mathematically fitted to the performance table, etc. Further, the mobile computing device can compute the value for normalized sensible EER each time that a measurement is received, such that the value for normalized sensible EER can be computed in real-time.

At 608, graphical data is displayed on the mobile computing device that is indicative of operating efficiency of the air conditioning unit, wherein the graphical data is displayed based upon the normalized sensible EER computed at 606. For example, the graphical data can depict a ratio of the normalized sensible EER to the expected sensible EER (determined at AHRI conditions). The technician can service the air conditioning unit while monitoring the updated graphical data until operating efficiency of the air conditioning unit is substantially optimized. The methodology 600 completes at 610.

Figure 7:
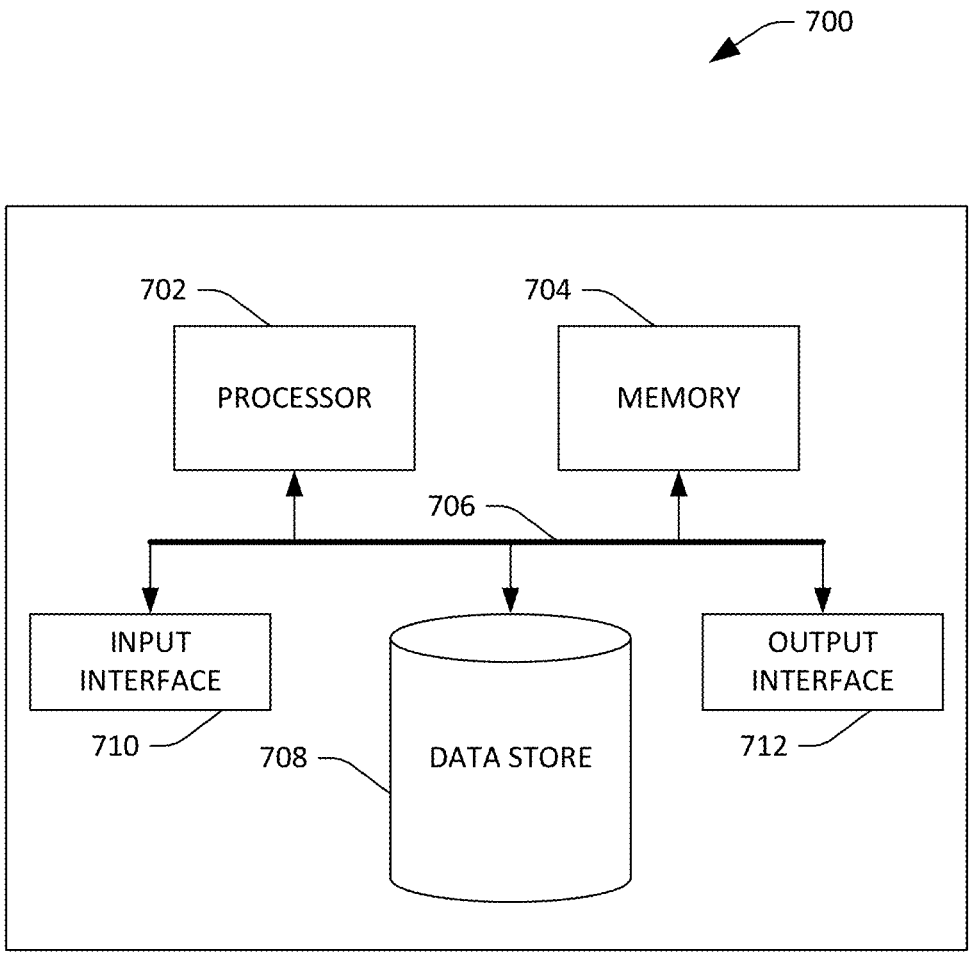
FIG. 7 is an exemplary computing system.

Referring now to FIG. 7, a high-level illustration of an exemplary computing device 700 that can be used in accordance with the systems and methodologies disclosed herein is illustrated. For instance, the computing device 700 may be used in a system that computes data that is indicative of operating efficiency of an air conditioning unit. By way of another example, the computing device 700 can be used in a system that generates a measurement that is indicative of a current operating parameter of an air conditioning unit. The computing device 700 includes at least one processor 702 that executes instructions that are stored in a memory 704. The instructions may be, for instance, instructions for implementing functionality described as being carried out by one or more components discussed above or instructions for implementing one or more of the methods described above. The processor 702 may access the memory 704 by way of a system bus 706. In addition to storing executable instructions, the memory 704 may also store performance tables, compressor maps, measurements, etc.

The computing device 700 additionally includes a data store 708 that is accessible by the processor 702 by way of the system bus 706. The data store 708 may include executable instructions, performance tables, measurements, compressor maps, etc. The computing device 700 also includes an input interface 710 that allows external devices to communicate with the computing device 700. For instance, the input interface 710 may be used to receive instructions from an external computer device, from a user, etc. The computing device 700 also includes an output interface 712 that interfaces the computing device 700 with one or more external devices. For example, the computing device 700 may display text, images, etc. by way of the output interface 712.

It is contemplated that the external devices that communicate with the computing device 700 via the input interface 710 and the output interface 712 can be included in an environment that provides substantially any type of user interface with which a user can interact. Examples of user interface types include graphical user interfaces, natural user interfaces, and so forth. For instance, a graphical user interface may accept input from a user employing input device(s) such as a keyboard, mouse, remote control, or the like and provide output on an output device such as a display. Further, a natural user interface may enable a user to interact with the computing device 700 in a manner free from constraints imposed by input devices such as keyboards, mice, remote controls, and the like. Rather, a natural user interface can rely on speech recognition, touch and stylus recognition, gesture recognition both on screen and adjacent to the screen, air gestures, head and eye tracking, voice and speech, vision, touch, gestures, machine intelligence, and so forth.

Additionally, while illustrated as a single system, it is to be understood that the computing device 700 may be a distributed system. Thus, for instance, several devices may be in communication by way of a network connection and may collectively perform tasks described as being performed by the computing device 700.

Various functions described herein can be implemented in hardware, software, or any combination thereof. If implemented in software, the functions can be stored on or transmitted over as one or more instructions or code on a computer-readable medium. Computer-readable media includes computer-readable storage media. A computer-readable storage media can be any available storage media that can be accessed by a computer. By way of example, and not limitation, such computer-readable storage media can comprise random-access memory (RAM), read-only memory (ROM), electrically erasable programmable read-only memory (EEPROM), compact disc-read-only memory (CD-ROM) or other optical disk storage, magnetic disk storage or other magnetic storage devices, or any other medium that can be used to carry or store desired program code in the form of instructions or data structures and that can be accessed by a computer. Disk and disc, as used herein, include compact disc (CD), laser disc, optical disc, digital versatile disc (DVD), floppy disk, and Blu-ray disc (BD), where disks usually reproduce data magnetically and discs usually reproduce data optically with lasers. Further, a propagated signal is not included within the scope of computer-readable storage media. Computer-readable media also includes communication media including any medium that facilitates transfer of a computer program from one place to another. A connection, for instance, can be a communication medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio and microwave are included in the definition of communication medium. Combinations of the above should also be included within the scope of computer-readable media.

Alternatively, or in addition, the functionally described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), etc.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A mobile computing device that is configured to present graphical data to a technician servicing an air conditioning unit having a sensible latent split, wherein the mobile computing device comprises:

a processor; and memory storing instructions that, when executed by the processor, cause the processor to perform acts comprising:

receiving, from a tool that is coupled to the air conditioning unit, a measurement that is indicative of an operating parameter of the air conditioning unit;

based upon the measurement and the sensible latent split, computing a value for normalized sensible energy efficiency ratio (EER), wherein the value for normalized sensible EER is indicative of an operating efficiency of the air conditioning unit; and displaying graphical data based upon the computed value for the normalized sensible EER, wherein the graphical data is indicative of the operating efficiency of the air conditioning unit relative to an expected operating efficiency of the air conditioning unit.

2. The mobile computing device of claim 1 being a mobile telephone.

3. The mobile computing device of claim 1, wherein the measurement is received by way of a Bluetooth connection between the mobile computing device and the tool.

4. The mobile computing device of claim 1, wherein the expected operating efficiency corresponds to a rated load comprising at least one of an envelope temperature of about 80° F., an envelope relative humidity of about 50%, or an ambient temperature of about 95° F.

5. The mobile computing device of claim 1, the acts further comprising:

receiving, from the tool that is coupled to the air conditioning unit, a second measurement that is indicative of the operating parameter of the air conditioning unit;

based upon the second measurement, computing a second value for normalized sensible EER; and updating the graphical data on the display based upon the second computed value for the normalized sensible EER.

6. The mobile computing device of claim 1, wherein the measurement is indicative of sensible BTUH output/watts of the air conditioning unit.

7. The mobile computing device of claim 1, wherein the measurement is indicative of power being consumed by the air conditioning unit.

8. The mobile computing device of claim 1, wherein computing the value for normalized sensible EER comprises accessing a performance table of the air conditioning unit, wherein the value for normalized sensible EER is based upon data in the performance table of the air conditioning unit.

9. The mobile computing device of claim 1, the acts further comprising:

based upon the value for normalized sensible EER, outputting a recommendation to the technician, wherein the recommendation, when followed by the technician, is configured to result in an increase in the normalized sensible EER for the air conditioning unit.

10. A computer-readable storage medium of a mobile telephone of a technician who is servicing an air conditioning unit having a sensible latent split, the computer-readable storage medium comprising instructions that, when executed by a processor of the mobile telephone, cause the processor to perform acts comprising:

receiving, from a tool that is coupled to the air conditioning unit, a measurement that is indicative of an operating parameter of the air conditioning unit;

based upon the measurement and the sensible latent split, computing a value for normalized sensible energy efficiency ratio (EER), wherein the value for normalized sensible EER is indicative of an operating efficiency of the air conditioning unit; and displaying, on a display of the mobile telephone, graphical data, wherein the graphical data is based upon the computed value for the normalized sensible EER, wherein the graphical data is indicative of the operating efficiency of the air conditioning unit relative to an expected operating efficiency of the air conditioning unit.

11. The computer-readable storage medium of claim 10, the acts further comprising:

causing a recommendation to be displayed on the display based upon the computed value, wherein the recommendation, when followed by the technician, is configured to cause the value for normalized sensible EER to increase.

12. A method performed by a computing system, the method comprising:

receiving a measurement related to an air conditioning unit and a sensible latent split of the air conditioning unit that is being serviced by a technician, wherein the measurement is indicative of an operating condition of the air conditioning unit;

computing, based upon the measurement and the sensible latent split, a value for normalized sensible energy efficiency ratio (EER) for the air conditioning unit, wherein the value for normalized sensible EER is indicative of an operating efficiency of the air conditioning unit at current operating conditions; and causing graphical data to be presented on a display of a mobile computing device of the technician, wherein the graphical data is based upon the computed value for normalized sensible EER, and further wherein the graphical data is configured to inform the technician of the operating efficiency of the air conditioning unit relative to an expected operating efficiency of the air conditioning unit.

13. The method of claim 12, wherein the computing system is a server computing device that is in network communication with the mobile computing device of the technician.

14. The method of claim 12, wherein the computing system is the mobile computing device of the technician.

15. The method of claim 12, wherein the measurement is received from the mobile computing device of the technician, and further wherein the measurement is input to the mobile computing device by the technician.

16. The method of claim 12, wherein the measurement is received from a tool that is coupled to the air conditioning unit, wherein the measurement is received at the computing system by way of a wireless connection between the tool and the computing system.

17. The method of claim 12, wherein the expected operating efficiency corresponds to a rated load comprising at least one of an envelope temperature of about 80° F., an envelope relative humidity of about 50%, or an ambient temperature of about 95° F.

18. The method of claim 12, wherein computing the value comprises accessing a performance table of the air conditioning unit, wherein the value is computed based upon data in the performance table.

19. The method of claim 18, wherein computing the value comprises:

identifying a correction factor in the performance table based upon the measurement; and multiplying the correction factor by an Air Conditioning, Heating, and Refrigeration Institute (AHRI) rating of the air conditioning unit to generate a second value, wherein the value is computed based upon the second value.

20. The method of claim 19, wherein computing the value further comprises:

multiplying the second value by a ratio of sensible cooling capacity to latent cooling capacity of the air conditioning unit to generate a third value, wherein the value is computed based upon the third value.

* * * * *